United States Patent [19]

Daigle

[11] 4,162,705

[45] Jul. 31, 1979

[54] CENTER SECTION FOR OIL WELL PERFORATION TESTING DEVICE

[76] Inventor: Milton L. Daigle, 359 S. Van Ave., Houma, La. 70306

[21] Appl. No.: 901,307

[22] Filed: Apr. 28, 1978

Related U.S. Application Data

[63] Continuation-in-part of Ser. No. 802,481, Jun. 1, 1977, Pat. No. 4,103,741.

[51] Int. Cl.[2] ..... E21B 33/122

[52] U.S. Cl. ..... 166/186; 166/242; 285/133 R

[58] Field of Search ..... 166/186, 242, 147, 127; 285/132, 133 R; 138/114

[56] References Cited

U.S. PATENT DOCUMENTS

| | | | |
|---|---|---|---|
| 2,297,020 | 9/1942 | Page | 166/186 |
| 3,865,188 | 2/1975 | Doggett et al. | 166/186 |

*Primary Examiner*—James A. Leppink

*Attorney, Agent, or Firm*—Clarence A. O'Brien; Harvey B. Jacobson

[57] ABSTRACT

A pair of elongated inner and outer tubular members are provided with pairs of corresponding loosely telescoped opposite end portions defining annular passages therebetween. The midportions of the tubular members are secured relative to each other and include port structure communicating the interior of the central portion of the inner tubular member with the exterior of the central portion of the outer tubular member. In addition, the inner and outer tubular members include coacting structure, in the areas of the midportions thereof, communicating the aforementioned annular passages with each other independent of the exterior of the outer tubular member, the interior of the inner tubular member and the port structure communicating the interior of the midportion of the inner member with the exterior of the midportion of the outer member.

4 Claims, 10 Drawing Figures

CENTER SECTION FOR OIL WELL PERFORATION TESTING DEVICE

CROSS-REFERENCE TO RELATED APPLICATION

This application comprises a continuation-in-part of my copending U.S. application Ser. No. 802,481, filed June 1, 1977, for Oil Well Perforation Testing Device, now U.S. Pat. No. 4,103,741.

BACKGROUND OF THE INVENTION

This application discloses three forms of center sections which may be utilized in lieu of the center section of my above-noted prior patented perforation testing device. Each of the three forms herein disclosed may be utilized as a replacement for the corresponding component of my prior patented perforation testing device and may be used, to advantage, in certain instances within the perforation testing device. The structure and operation of the various components of the oil well perforation testing device disclosed in my above pending application, as well as the prior art of record therein are included herein by reference thereto.

SUMMARY OF THE INVENTION

The main object of this invention is to provide a center section for an oil well perforation testing device which may be more readily constructed.

Another object of this invention is to provide a center section which may be more readily constructed at a lower cost.

Yet another object of this invention is to provide a center section which will be reliable in operation and more economically feasible.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
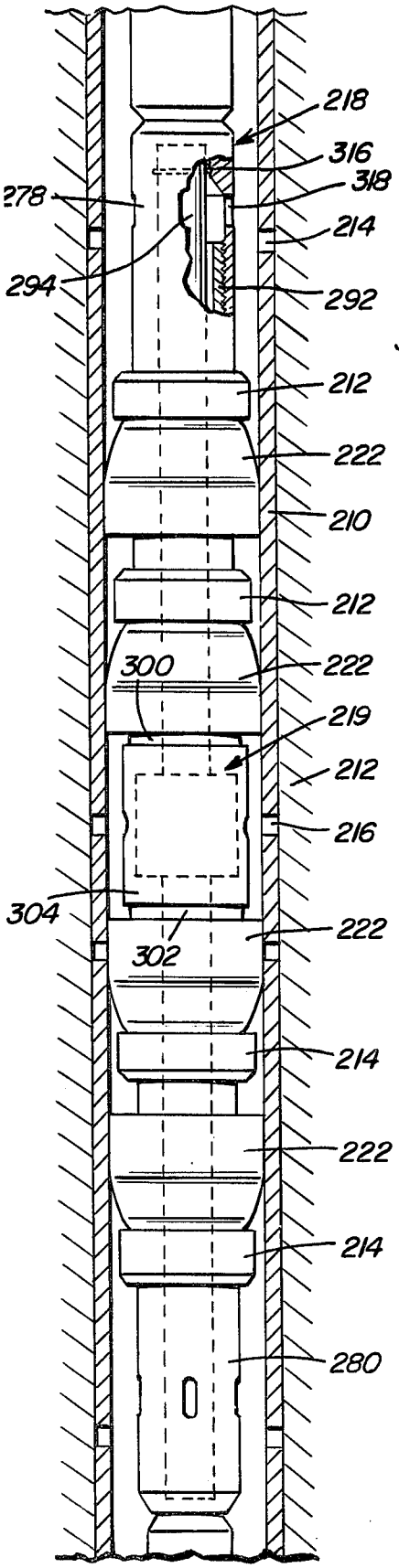
FIG. 1 is a side elevational view of the oil well perforation testing device center section of the instant invention within a well casing, the casing and surrounding formation as well as portions of the center section and an adjacent tool sub being broken away and illustrated in vertical section.
Figure 2:
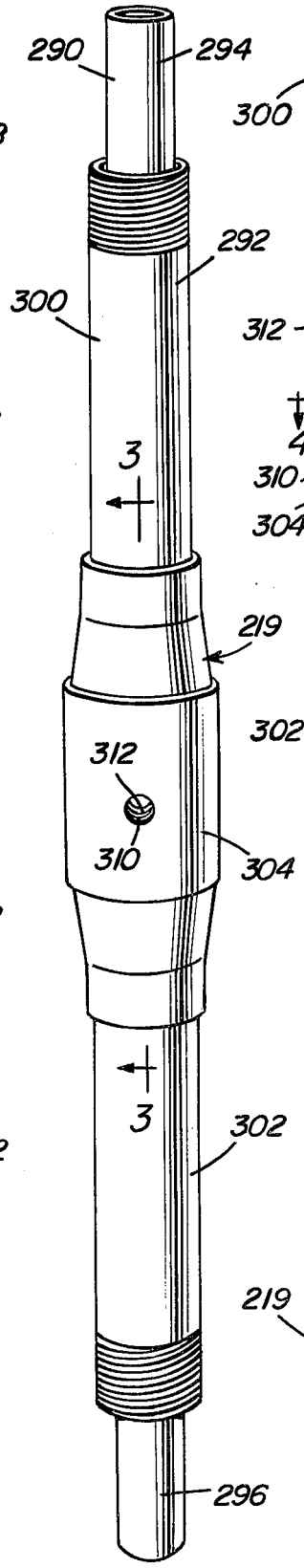
FIG. 2 is a perspective view of the center section illustrated in FIG. 2 and with the packers thereof removed.
Figure 3:
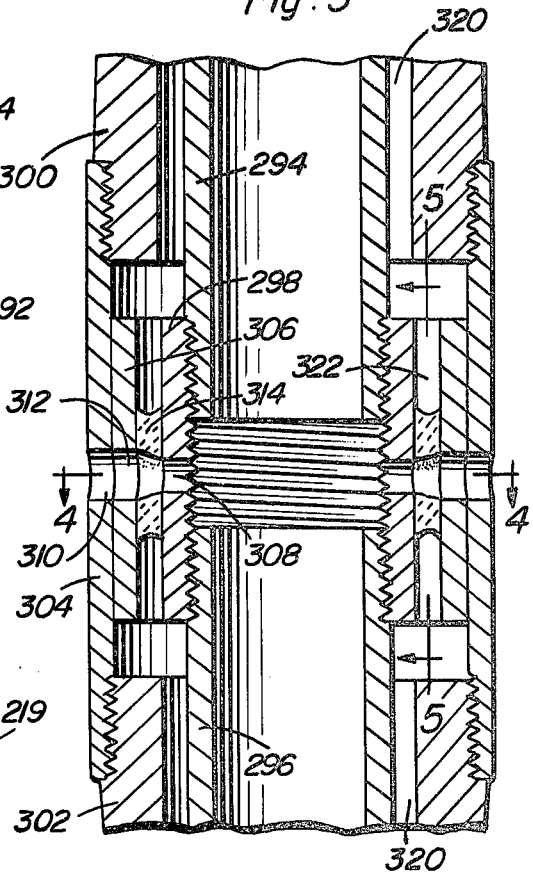
FIG. 3 is an enlarged, fragmentary, vertical sectional view taken substantially upon the plane indicated by the section line 3—3 of FIG. 2.
Figure 4:
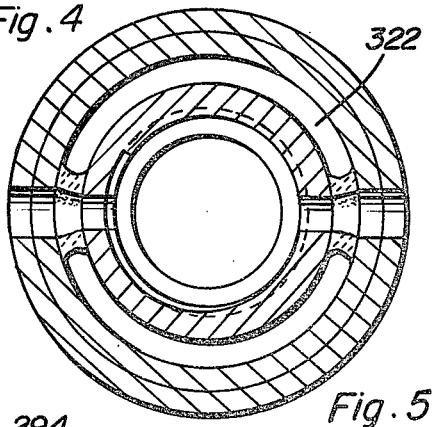
FIG. 4 is a horizontal sectional view taken substantially upon the plane indicated by the section line 4—4 of FIG. 3.

Referring now more specifically to the drawings, the numeral 210 designates a well casing projecting downwardly through a production zone 212. The casing 210 is perforated at vertically spaced zones therealong as at 214 and 216.

For various reasons, it may become necessary to wash the perforations 216 or to acidize or plasticize, etc. In addition, it is also sometimes necessary to reperforate.

The tool disclosed in my above noted U.S. Pat. No. 4,103,741 is operative to perform the above operations during one trip into the casing 210. The perforation testing device of the instant invention is referred to in general by the reference numeral 218 and includes a center section referred to in general by the reference 219 serially connected between subs 278 and 280 corresponding to subs 78 and 80 as disclosed in my above noted prior U.S. patent. The center assembly 219 includes packer cup thimbles 212 and 214 and packer cups 222 corresponding to the thimbles 12 and 14 and the cups 22 of my prior patented perforation testing device.

Figure 5:
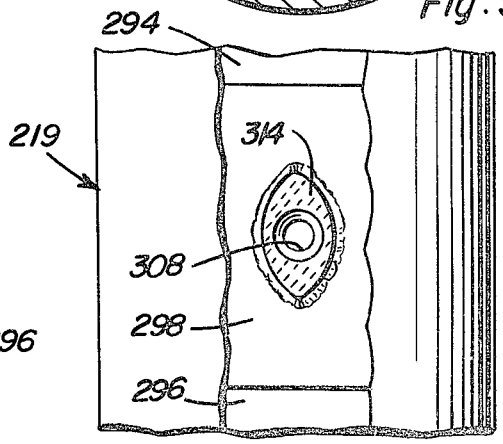
FIG. 5 is a fragmentary, vertical sectional view taken substantially upon the plane indicated by the section line 5—5 of FIG. 3.

The center section 219 further includes an inner tubular member 290 and an outer tubular section 292. The inner tubular member 290 comprises a pair of aligned opposite end tubular member components 294 and 296 whose adjacent ends are removably threadedly engaged within a diametrically enlarged inner tubular member midportion 298. The outer tubular section 292 includes a pair of aligned opposite end tubular section components 300 and 302 whose adjacent ends are threadedly engaged in opposite end portions of an outer diametrically enlarged tubular midportion 304 and a sleeve 306 is loosely telescoped over the diametrically enlarged inner midportion 298 and sealingly secured within the midportion 304 in any convenient manner, such as by a shrink fit. The inner midportion 298, outer midportion 304 and the the sleeve 306 include pairs of aligned diametrically opposite ports 308, 310 and 312, respectively, and the sleeve 306 is secured about the inner midportion 298 in concentric relation therewith by means of welding 314 secured and built up between the sleeve 306 and the midportion 298 about the adjacent ends of the ports 308 and 312. Further, the remote ends of the tubular member components 294 and 296 are slidingly sealingly secured within the remote end portions of the subs 278 and 280 by means of O-rings 316 carried by each of the subs 278 and 280 and the remote ends of the tubular section components 300 and 302 are externally threaded and threaded within the adjacent ends of the subs 278 and 280. Also, the subs 278 and 280 include circumferential radial slots or ports 318 formed therein between the corresponding ends of the inner tubular member 290 and the outer tubular section 292. Accordingly, the ports or slots 318, the annular passages 320 defined between corresponding remote ends of the member 290 and section 292 and the annular space 322 defined between the inner midportion 298 and the sleeve 306 define a bypass passage communicating the exterior of the tool assembly 218 above and below the packers 222. Also, the interiors of the tubular member components 294 and 296 and the inner midportion 298 define a central unobstructed and longitudinally straight passage through the assembly 219 and the ports 308, 310 and 312 as well as the welding 314 define port means communicating the exterior of the center section 219 between the packers 222 with the center longitudinal passage defined through the center section 219. As may be seen from FIG. 5 of the drawings, the welding 314 may be contoured to minimize the restriction to fluid flow through the bypass passage.

Figure 6:
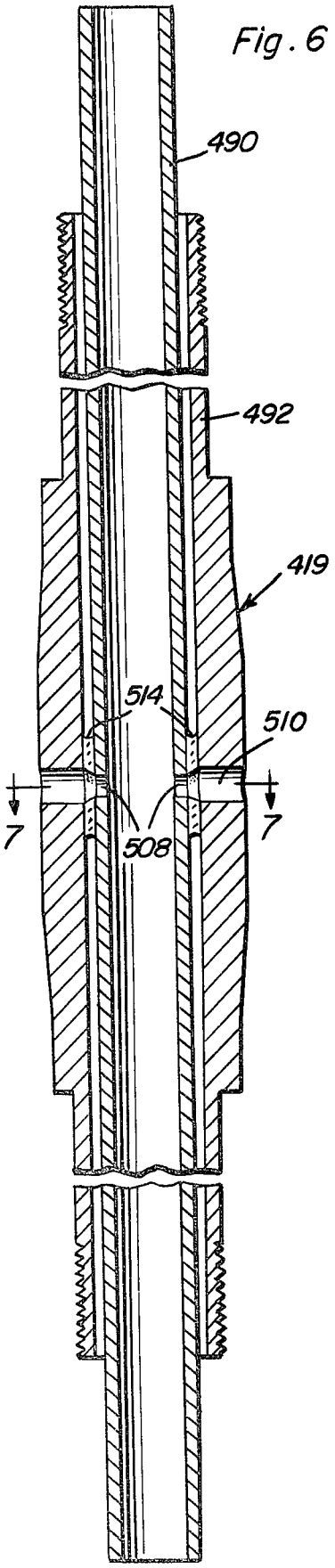
FIG. 6 is an enlarged, longitudinal, vertical sectional view of a second form of center section constructed in accordance with the present invention.
Figure 7:
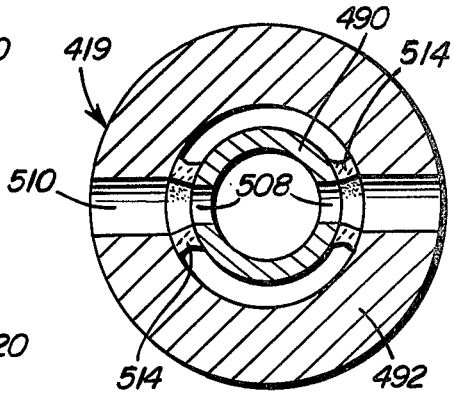
FIG. 7 is an enlarged, horizontal sectional view taken substantially upon the plane indicated by the section line 7—7 of FIG. 6.

With attention now invited more specifically to FIGS. 6 and 7 of the drawings, a modified form of center assembly referred to in general by the reference numeral 419 may be seen. The center assembly 419 is generally similar in structure and substantially identical in operation to the center section 219. The center section 419 differs from the center section 219 in that the inner tubular member 490 thereof corresponding to the tubular member 290 is of one-piece construction and the outer tubular section 492 thereof corresponding to the tubular section 292 is of one-piece construction. However, while the inner tubular member 490 includes ports 508 corresponding to the ports 308 and the outer tubular section 492 includes ports 510 corresponding to the ports 310, the entire spacing between the midportions of the inner tubular member 490 and the outer tubular section 492 about the adjacent ends of registered ports 508 and 510 is closed by means of welding 514 corresponding to the welding 314. Thus, it may be seen that the center section 419 comprises a full substitute for the center section 219.

Figure 8:
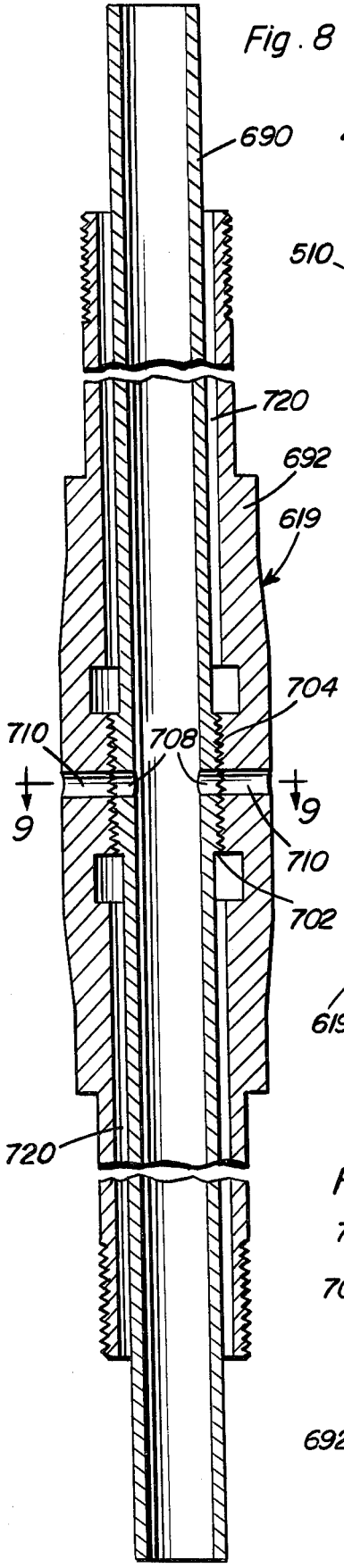
FIG. 8 is an enlarged, vertical sectional view similar to FIG. 6 but illustrating a third form of center section.
Figure 10:
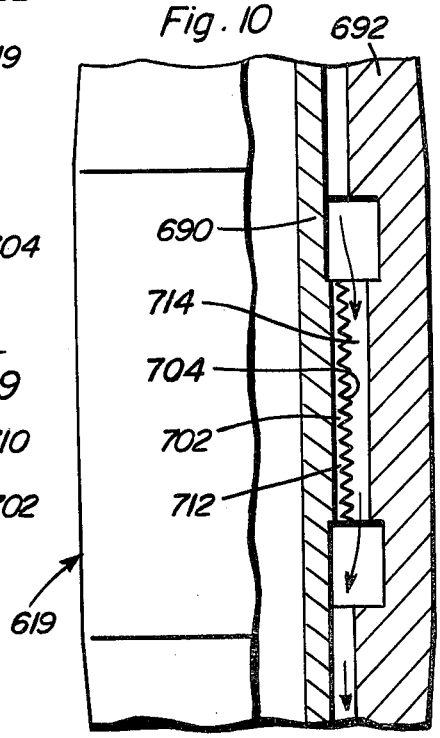
Figure 9:
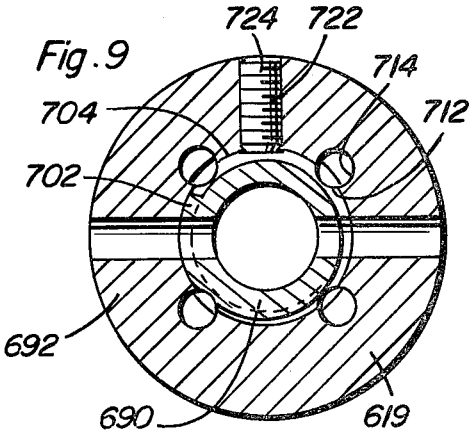
FIG. 9 is an enlarged, horizontal sectional view taken substantially upon the plane indicated by the section line 9—9 of FIG. 8; and, FIG. 10 is an enlarged, fragmentary, elevational view of the midportion of the center section illustrated in FIG. 8 and with parts thereof being broken away and illustrated in vertical section.

With attention now invited more specifically to FIGS. 8, 9 and 10 of the drawings, there will be seen a third form of center section referred to in general by the reference numeral 619. Here again, the inner tubular member 690 and the outer tubular section 692 of the center section 619 are each of one-piece construction. However, the midportion of the inner tubular member 690 includes an externally threaded slightly diametrically enlarged portion 702 threadedly engaged within an internally threaded central portion 704 of the outer tubular section 692 and registered portions of the threaded engaged portions 702 and 704 include registered and circumferentially spaced longitudinal grooves 712 and 714, respectively, defining communication paths between adjacent ends of the annular areas 720 between corresponding opposite ends of the inner tubular member 690 and the outer tubular section 692. Further, the outer tubular section 692 includes a threaded radial bore 722 in which a set screw 724 is threadedly engaged and the inner end of the set screw 724 is threaded against the opposing portion of the externally threaded diametrically enlarged midportion 702 whereby the inner tubular member 690 and outer tubular section 692 are locked against relative rotation and the member 690 and section 692 include pairs of aligned ports 708 and 710. Accordingly, it may be seen that the center section 619 also comprises a center section which may be readily substituted for the center section 219.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a pair of axially spaced tubular well tool subsections including adjacent end portions and to be serially connected in an elongated well tool to include a central longitudinal passage therethrough, an outlet from said passage to the exterior of said tool between longitudinally spaced packer zones thereof spaced between said sections and a fluid bypass through said tool, independent of said longitudinal passage, communicated at its opposite ends with the exterior of said tool on remote sides of said packer zones, a tool assembly for connection between said sections, said assembly including an inner tubular member and an outer tubular section telescoped over said inner tubular member, said inner member and outer section including pairs of corresponding loosely telescoped end portions defining annular passages therebetween, first means sealingly coupling the end portions of said inner tubular members within the adjacent end portions of said subsections, second means sealingly coupling the remote ends of said outer tubular member to said adjacent ends, one pair of section end portions including ports opening therethrough from the corresponding annular passages to the exterior of said tool assembly, said outer tubular section including axially spaced mounting portions disposed intermediate said ports for supporting packer assemblies therefrom, said assembly including port means communicating the interior of said inner tubular member with the exterior of said assembly intermediate said mounting portions independent of said annular passages and defining passage means communicating said annular passages independent of said port means and the interior of said inner tubular member, the interior of said inner tubular member being straight, unobstructed and "fully open" throughout the length of said inner tubular member, the inner tubular member including a diametrically enlarged midportion whose exterior is sealingly secured within the midportion of the interior of said outer tubular section, said port means comprising aligned ports formed through said sealingly secured midportions, said inner tubular member including a pair of opposite end member sections and a center member section into which the adjacent ends of said end member sections are removably threadedly engaged and comprising said diametrically enlarged midportion, a sleeve secured within the midportion of said outer tubular section, said outer tubular section midportion, said sleeve and diametrically enlarged midportion having aligned ports formed therethrough, said diametrically enlarged midportion being loosely telescoped in said sleeve defining an annular passage therebetween, and weld material formed completely about the adjacent ends of said sleeve and enlarged midportion ports bridging said annular passage, said aligned ports and weld material defining said port means.

2. In combination with a pair of axially spaced tubular well tool subsections including adjacent end portions and to be serially connected in an elongated well tool to include a central longitudinal passage therethrough, an outlet from said passage to the exterior of said tool between longitudinally spaced packer zones thereof spaced between said sections and a fluid bypass through said tool, independent of said longitudinal passage, communicated at its opposite ends with the exterior of said tool on remote sides of said packer zones, a tool assembly for connection between said sections, said assembly including an inner tubular member and an outer tubular section telescoped over said inner tubular member, said inner member and outer section including pairs of corresponding loosely telescoped end portions defining annular passages therebetween, first means sealingly coupling the end portions of said inner tubular members within the adjacent end portions of said subsections, second means sealingly coupling the remote ends of said outer tubular member to said adjacent ends, one pair of section end portions including ports opening therethrough from the corresponding annular passages to the exterior of said tool assembly, said outer tubular section including axially spaced mounting portions disposed intermediate said ports for supporting packer assemblies therefrom, said assembly including port means communicating the interior of said inner tubular member with the exterior of said assembly intermediate said mounting portions independent of said annular passages and defining passage means communicating said annular passages independent of said port means and the interior of said inner tubular member, the interior of said inner tubular member being straight, unobstructed and "fully open" throughout the length of said inner tubular member, said inner tubular member and other tubular section each being of one-piece construction and loosely telescopingly engaged, said port means including aligned ports formed in the midportions of said inner tubular member and outer tubular section as well as weld material formed completely about the adjacent ends of said aligned ports and bridging the space between the opposing portions of said midportions extending about said adjacent port ends.

3. In combination with a pair of axially spaced tubular well tool subsections including adjacent end portions and to be serially connected in an elongated well tool to include a central longitudinal passage therethrough, an outlet from said passage to the exterior of said tool between longitudinally spaced packer zones thereof spaced between said sections and a fluid bypass through said tool, independent of said longitudinal passage, communicated at its opposite ends with the exterior of said tool on remote sides of said packer zones, a tool assembly for connection between said sections, said assembly including an inner tubular member and an outer tubular section telescoped over said inner tubular member, said inner member and outer section including pairs of corresponding loosely telescoped end portions defining annular passages therebetween, first means sealingly coupling the end portions of said inner tubular members within the adjacent end portions of said subsections, second means sealingly coupling the remote ends of said outer tubular member to said adjacent ends, one pair of section end portions including ports opening therethrough from the corresponding annular passages to the exterior of said tool assembly, said outer tubular section including axially spaced mounting portions disposed intermediate said ports for supporting packer assemblies therefrom, said assembly including port means communicating the interior of said inner tubular member with the exterior of said assembly intermediate said mounting portions independent of said annular passages and defining passage means communicating said annular passages independent of said port means and the interior of said inner tubular member, the interior of said inner tubular member being straight, unobstructed and "fully open" throughout the length of said inner tubular member, the inner tubular member including a diametrically enlarged midportion whose exterior is sealingly secured within the midportion of the interior of said outer tubular section, said port means comprising aligned ports formed through said sealingly secured midportions, said inner tubular member diametrically enlarged midportion being externally threaded, the interior of the midportion of said outer tubular section being slightly diametrically reduced, threaded and having said diametrically enlarged midportions sealingly threaded therein and in adjusted angular position relative thereto, the exterior of said diametrically enlarged midportion and the interior of said diametrically reduced midportion of said outer tubular member including registered longitudinal outwardly and inwardly opening grooves formed therein and communicating said annular passage, said grooves being angularly spaced about said midportions from said aligned ports.

4. The combination of claim 3 including means releasably locking said midportions in adjusted threaded relation.

* * * * *